US008235247B2

(12) United States Patent
Alvarez

(10) Patent No.: US 8,235,247 B2
(45) Date of Patent: Aug. 7, 2012

(54) SYSTEMS, METHODS AND DEVICES FOR DISPENSING PRODUCTS FROM A KIOSK

(75) Inventor: Eduardo Alvarez, Lexington, MA (US)

(73) Assignee: VIGIX, Inc., Stoneham, MA (US)

( * ) Notice: Subject to any disclaimer, the term of this patent is extended or adjusted under 35 U.S.C. 154(b) by 616 days.

(21) Appl. No.: 11/921,322

(22) PCT Filed: May 31, 2006

(86) PCT No.: PCT/US2006/021027

§ 371 (c)(1),
(2), (4) Date: Jun. 23, 2010

(87) PCT Pub. No.: WO2006/130638

PCT Pub. Date: Dec. 7, 2006

(65) Prior Publication Data

US 2010/0314405 A1 Dec. 16, 2010

Related U.S. Application Data

(60) Provisional application No. 60/685,968, filed on May 31, 2005, provisional application No. 60/739,746, filed on Nov. 23, 2005.

(51) Int. Cl.
*G07F 11/72* (2006.01)

(52) U.S. Cl. ..... 221/30; 221/312 A; 221/150 A; 221/124

(58) Field of Classification Search ..... 221/30, 221/150 A, 312 A, 124
See application file for complete search history.

(56) References Cited

U.S. PATENT DOCUMENTS

| | | | | |
|---|---|---|---|---|
| 4,997,076 | A | 3/1991 | Hirschfeld et al. | |
| 5,102,008 | A * | 4/1992 | Kaufman et al. | 221/30 |
| 5,139,384 | A | 8/1992 | Tuttobene | |
| 6,655,580 | B1 * | 12/2003 | Ergo et al. | 235/375 |
| 7,797,077 | B2 * | 9/2010 | Hale | 221/197 |
| 2002/0038167 | A1 | 3/2002 | Chirnomas | |
| 2004/0232227 | A1 | 11/2004 | Kusakawa | |

FOREIGN PATENT DOCUMENTS

| | | |
|---|---|---|
| JP | 52-110094 | 9/1977 |
| JP | 05-089345 | 4/1993 |
| JP | 09-128615 | 5/1997 |
| WO | WO 2005/005266 A2 | 1/2005 |

* cited by examiner

*Primary Examiner* — Timothy Waggoner
(74) *Attorney, Agent, or Firm* — Wolf, Greenfield & Sacks, P.C.

(57) ABSTRACT

The present invention relates to a kiosk that dispenses products with no moving parts. The kiosk can dispense a rental product, and the rental product can be returned via a mail service, or it can be retained for a purchase price. The kiosk comprises a removable cartridge containing the products, and the cartridge can be readily replaced with a new cartridge to replenish the inventory of products in the kiosk.

21 Claims, 7 Drawing Sheets

SYSTEMS, METHODS AND DEVICES FOR DISPENSING PRODUCTS FROM A KIOSK

RELATED APPLICATIONS

This application is a national stage filing under 35 U.S.C. §371 of PCT International application PCT/US2006/021027, designating the United States of America, and filed May 31, 2006, which was published under PCT Article 21(2) in English. PCT/US2006/021027 claims benefit under 35 U.S.C. §119 of U.S. provisional application Ser. No. 60/739,746, filed Nov. 23, 2005 and provisional application Ser. No. 60/685,968 filed May 31, 2005.

BACKGROUND OF THE INVENTION

The present invention relates to a kiosk that dispenses products using no moving parts. The kiosk can dispense a rental product, and the rental product can be returned via a mail service, or it can be retained for a purchase price. The kiosk comprises a removable cartridge containing the products, and the cartridge can be readily replaced with a new cartridge to replenish the inventory of products in the kiosk.

DISCUSSION OF RELATED ART

Numerous kiosks have been developed for dispensing products without the presence of a salesperson or vendor in a self-serve manner. These kiosks have tended to suffer from numerous problems, which have prevented their wide adoption. Previous kiosks have tended to have numerous moving parts, which tend to break, resulting in lost sales and requiring repair. They also have tended to be relatively large machines requiring a large footprint, which is not always available in potential kiosk locations and often requires that the kiosk occupy wallspace. In addition, kiosks have tended to be stocked like vending machines, requiring each individual product to be added at the kiosk to the proper location in the kiosk to take the place of the dispensed product. Where the kiosk rents products, the individual products still have to be added (returned) to known kiosks to the proper location in the kiosk, either by the customer (requiring a complicated mechanism to return the product to the proper location), or by a technician (requiring a visit by this trained person).

BRIEF SUMMARY OF THE INVENTION

The present invention overcomes each of the above identified problems with prior kiosks in a series of separate embodiments. Of course, while the separate embodiments may stand on their own, they can also be combined, and they overcome other deficiencies with prior kiosks.

The present invention relates to a kiosk that dispenses products with no moving parts. The kiosk can dispense a rental product, and the rental product can be returned via a mail service, or it can be retained for a purchase price. The kiosk comprises a removable cartridge containing the products, and the cartridge can be readily replaced with a new cartridge to replenish the inventory of products in the kiosk.

An embodiment of the invention is a device for storing and delivering an article on demand comprising a storage container configured to contain a plurality of the articles, a user interface configured to enable a user to indicate a selection of at least one of the articles to be delivered by the device to a location accessible to the user, a retainer within the storage container configured to secure the plurality of articles within the storage container and to release only the article selected by the user, wherein the retainer is constructed so that it releases the selection without mechanical motion of any part of the retainer configured to secure the plurality of articles. The device can be a kiosk, and the article can be a digital video disc (DVD), compact disc (CD), UMD optical disc, HD-D, memory card, video tape cassette, audio tape cassette, or other article comprising a computer readable medium. The container can be configured to be readily insertable into the kiosk, and the user interface can comprises a computer-implemented system in electrical communication with the retainer.

Dispensing without moving parts of the device can be avoided in an embodiment by using a retainer comprising at least one securing component, at least a portion of which is electrically conductive, constructed and arranged to secure the a package containing the article when the securing component is in a first state in which no electrical potential or an electrical potential of a first value is applied to the securing component and to release the article by applying sufficient current to heat the electrically conductive portion of the retainer sufficiently to cause failure of a portion of the package and release of the article from the securing component when the securing component is in a second state in which a second value is applied to the securing component.

Alternatively, dispensing can be achieved without moving parts of the device where each article is retained in a package and each retainer comprises a projection comprising an electrically conductive material from which the package hangs, wherein, when an electric current is applied to the electrically conductive material, it heats and it melts through the portion of the package hanging from the projection, releasing the package. The securing component can be made from titanium, and the package can be made of styrofoam, polypropylene, or very fine, high-density polyethylene fibers, such as TYVEK®.

An embodiment of the invention also comprises a retainer device for releasibly securing an article comprising at least one securing component, at least a portion of which is electrically conductive, constructed and arranged to secure the article when the securing component is in a first state in which no electrical potential or an electrical potential of a first value is applied to the securing component and to release the article by applying sufficient heat locally to a portion of a package containing the article, which portion is secured by the component, so as to cause failure of the portion of the article and release of the article from the securing component when the securing component is in a second state in which an of a second value is applied to the securing component. The articles can be contained within a package having a portion thereof configured to securely engage with at least one securing component. The portion of the package configured to securely engage with at least one securing component can comprise a hole, groove, or indent and wherein the securing component comprises a hook, tab, or peg, and the package can comprise an envelope, sleeve, or sheath formed, at least in part, from a meltable material.

The kiosk device for storing and delivering on demand an article comprising a digital video disc (DVD), compact disc (CD), video tape cassette, audio tape cassette, or other article comprising a computer readable medium can comprise an enclosed storage container configured to contain a plurality of the articles and configured to be readily removable from and insertable into the kiosk device, a user interface configured to enable a user to indicate a selection of at least one of the articles to be delivered by the device to a location accessible to the user, a retainer within the storage container configured to secure the plurality of articles within the storage container and to release only the selection for delivery to the user upon receipt of information from or derived from the user interface.

The invention also comprises a method comprising acts of providing a kiosk device for storing and delivering on demand an article comprising a digital video disc (DVD), compact disc (CD), video tape cassette, audio tape cassette, or other article comprising a computer readable medium to a user, receiving information upon or after use of the kiosk device by the user indicating the number and type of articles delivered to the user by the kiosk device and payment information identifying an account of the user to be charged for rental or purchase of the at least one article delivered to the user, providing instructions to the user indicating, for rental transactions, how to return the at least one article to complete a transaction upon completion of a rental period by postal service or common carrier. The method can comprise receiving information from the kiosk indicating the number and type of articles remaining in the device, and the method can also comprise determining, based upon the information from the kiosk indicating the number and type of articles remaining in the device, whether the kiosk needs to be replenished with a new supply of articles, and it can comprise replenishing the articles in the kiosk based upon the results of the determining act.

An embodiment of the invention also concerns a method comprising acts of locating titles in magazines, wherein the magazines are located in kiosks, changing the inventory of the titles by sending a delivery company personnel with a replacement magazine, having the delivery company personnel switch the old magazine with the replacement magazine, having the delivery company personnel return the old magazine to the vendor. The magazines have RFID devices, wherein the kiosk opens after detecting the RFID device of the replacement magazine.

An embodiment of the invention can also comprise advice for storing and delivering an article on demand comprising a storage container configured to contain a plurality of the articles, a user interface configured to enable a user to indicate a selection of at least one of the articles to be delivered by the device to a location accessible to the user, wherein the storage container is configured to be readily replaceable. The device can be replenished with articles by replacing the storage container with a replacement storage container containing a new collection of articles, and the storage container can contain a mechanism that signals its proximity to the device, causing the device to open, such as an RFID chip.

This invention is to be applied for the automated and semi-automated vending industry in general. The kiosk in one embodiment is particularly designed to be applied in the entertainment and educational information, media rental and sale industry, including but not limited to written publications, audio publications, movies, documentaries, games, and software. Products that can be rented or sold from the kiosk include, but are not limited to, digital media. "Digital media" includes any physical device that stores information, such as digital video discs (DVD), including disposable DVDs such as EZ-Ds, compact discs (CD), UMD optical discs, HD-D, and memory cards. A "digital media title" or "title" is hereinafter referred to as one digital media device containing one or more games, movies, songs and/or any intellectual property that can be expressed in a digital format. A digital media title need not be a product with a title of its own, such as a movie or a book, although the product may have such a title. In other words, a digital media title could be a disc containing numerous movies, and each movie might have its own title.

The kiosk has the possibility in one embodiment to offer additional services such as travel or event ticket sales and reservations and other information. The kiosk features means to deliver non-physical free, rented, or purchased digital information directly to the user through a wireless or wired data transmission transceiver in the form of an optic infrared port, electromagnetic or microwave antenna.

In one embodiment, the kiosk contains no moving parts for dispensing the titles, reducing the chance of mechanical failure or improperly dispensed product and providing a space savings. The titles are preferably located in the kiosk in packages, such as envelopes. Each package is suspended from a piece of metal, such as a wire or tab, and the packages are staggered at an angle so that they do not interfere with each other. When a user makes a selection and purchase or rental, the kiosk applies an electric current to the metal, melting the part of the package it contacts and allowing it to fall into the dispensing slot due to gravity. The package preferably is suspended from the tab by a hole in the package, and the electric current heats the metal to a temperature sufficient to cut through the portion of the package hanging on the tab or wire by melting that portion of the package. The package is preferably made from a relatively low melting point material, such as Styrofoam, polypropylene, or TYVEK®. The metal is preferably made from a material that heats in response to a current, such a titanium. The package containing the title can also be used to return the title. The package functions as a mailer. When a user is finished with the title, the user can return the title to the mailer, close the mailer, seal it, and return it to the vendor via a mail service. The envelope or mailer can already contain postage, the user can provide the postage, or the package can preferably be postage-paid. The mailer can contain terms of rental, directions for use, and advertisements. If the title is not returned in a certain period, a purchase price can be charged to the customer.

The kiosk has a small footprint, allowing it to be placed in valuable, but otherwise unused real estate, such as within a store or on a sidewalk. Wall space is a premium in public spaces, especially in stores. By having a small footprint, the kiosk can be placed away from a wall, allowing the wall to be used to sell, display, or advertise other goods. The kiosk can have a footprint of as little as about 1½' by about 1'.

The kiosk in one embodiment has a three-dimensional design to appear aesthetically pleasing from all sides. The kiosk can be secured by affixing it to the ground (e.g., floor or sidewalk) with an adhesive. A preferred adhesive is a silicon based adhesive, which can be removed by a solvent, such as a ultra-pure siloxane containing solvent. The kiosk can be readily relocated by dissolving the solvent. Its small size allows relocation to be accomplished by one person. The kiosk can include an RFID device to increase security.

The user-interface of the kiosk displays and plays visual and audio information about the titles contained in the kiosk to allow the user to select one or more titles. This information can include previews, "trailers," and customer ratings. A touch screen can be used to allow the user to preview, select, and purchase a title. Titles that are no longer in inventory for a particular kiosk are removed from the menu of selections and/or previews. Once the user has made a selection, he or she can pay for it using a credit card, a debit card, or an electronic account number and password. Then the kiosk delivers the media, and other related information to the user such as a printed receipt. The user can return rented titles directly to the kiosk, where they are stored until the inventory is changed, or via mail service.

In one embodiment, the kiosk contains only recent releases. While the kiosk may hold fewer DVDs than a video store, the majority of DVD rentals in video stores are new releases.

The kiosk's central processing unit connects to means for external data transmission, through a data network in the form of a telephone line, coaxial cable, fiber optic, LAN network, or any wireless system to maintain communication with a central control hub. The communication includes the information exchange of the media stock status and requirements, transactions, operational status, and the title selection.

The kiosk can be part of a network of kiosks controlled by one central control hub. The central control hub can be controlled by the kiosk owner for operational purposes, and this can be done remotely. In addition, consumers can in an embodiment remotely check the inventory of a particular kiosk. A title can be reserved and potentially purchased remotely and picked up later at a kiosk by swiping the credit card used to make the reservation and/or purchase.

The entire selection of physical media in the kiosk is located in a removable container. This container is exchanged by another one that has been replenished by a standard delivery company such as UPS and Federal Express, avoiding the need for dedicated vehicles. The removable container, hereinafter referred to as "cartridge" or "magazine", has the weight and size such that a single person can extract it from the kiosk to be able to insert its replacement. It can have wheels to allow easy transport by one person. In addition, by use of a device, such as an RFID, the kiosk can sense the proximity of the replacement magazine and open automatically. Thus, the delivery personnel can change the magazine without the use of any special skill or tool by simply removing the old magazine and replacing it with the new magazine. The delivery personnel could close the door, or the kiosk could do that automatically, such as when the old magazine is no longer nearby. To facilitate replenishment by a delivery company, the magazines can contain address label(s). The address label(s) can be printed at the central hub and it could be changed, covered, and/or removed by the kiosk to expose the return label.

The magazine can then be transported by the delivery company to a central hub for replenishment. The replenishment of the magazine at the central hub can be done manually or automatically. The magazines are replenished with a selection of titles that is specially suited to fulfill the demand of a specific kiosk based upon the past popularity of each title. New releases are particularly preferred. Centralized replenishment allows stronger quality control and keeps inventory to a minimum because there is no need for each technician visiting kiosks to replenish them to have a sufficient number and selection of movies to replenish each kiosk.

Unless otherwise specified, the terms "purchase" and "sale" are used throughout this application to include rental, lease, or loan and do not necessarily require actual payment. Similarly, the term "customer" includes persons purchasing, renting, leasing, or loaning titles or obtaining information. While a kiosk can often be a small device that provides money (e.g., an ATM), tickets (e.g., plane tickets) or information (e.g., tourist information), as used herein, a "kiosk" can include a traditional vending machine that provides physical product (e.g., snacks or food). A "mail service" or a "delivery service" can include any package delivery service, including but not limited to, government mail service (e.g., U.S. Postal Service) or private courier.

BRIEF DESCRIPTION OF THE DRAWINGS

The accompanying drawings are not intended to be drawn to scale. In the drawings, each Figure may contain its own numbering system so that numbers in one figure might not correspond to numbers in another figure. For purposes of clarity, not every component may be labeled in every drawing.

FIG. 9 contains diagrams of a package for a DVD.

DETAILED DESCRIPTION OF THE INVENTION

Figure 1:
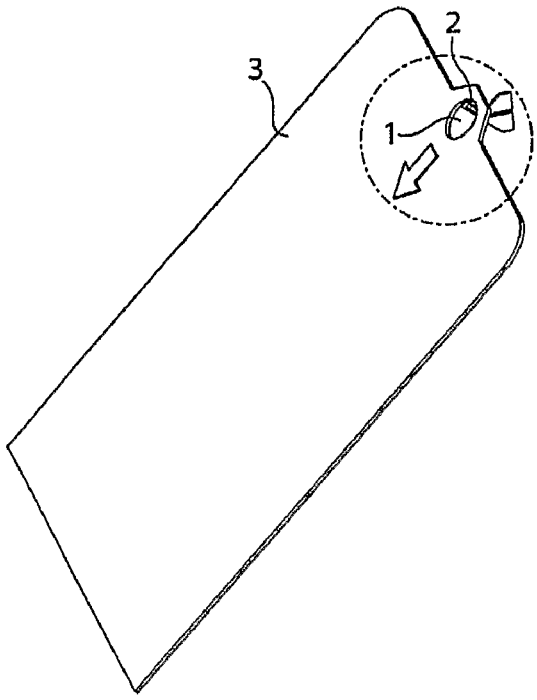
FIG. 1 shows the dispensing system with no moving parts. The package (3) holds the product contains an opening (1). The package (3) hangs from a tab (2) protruding through the opening (1).

Applicants will now describe the claimed invention in terms of particular embodiments. The invention is not limited in its application to the details of construction and the arrangement of components set forth in the exemplified embodiments, nor in the drawings. The invention is capable of other embodiments and of being practiced or of being carried out in various ways.

Figure 8:
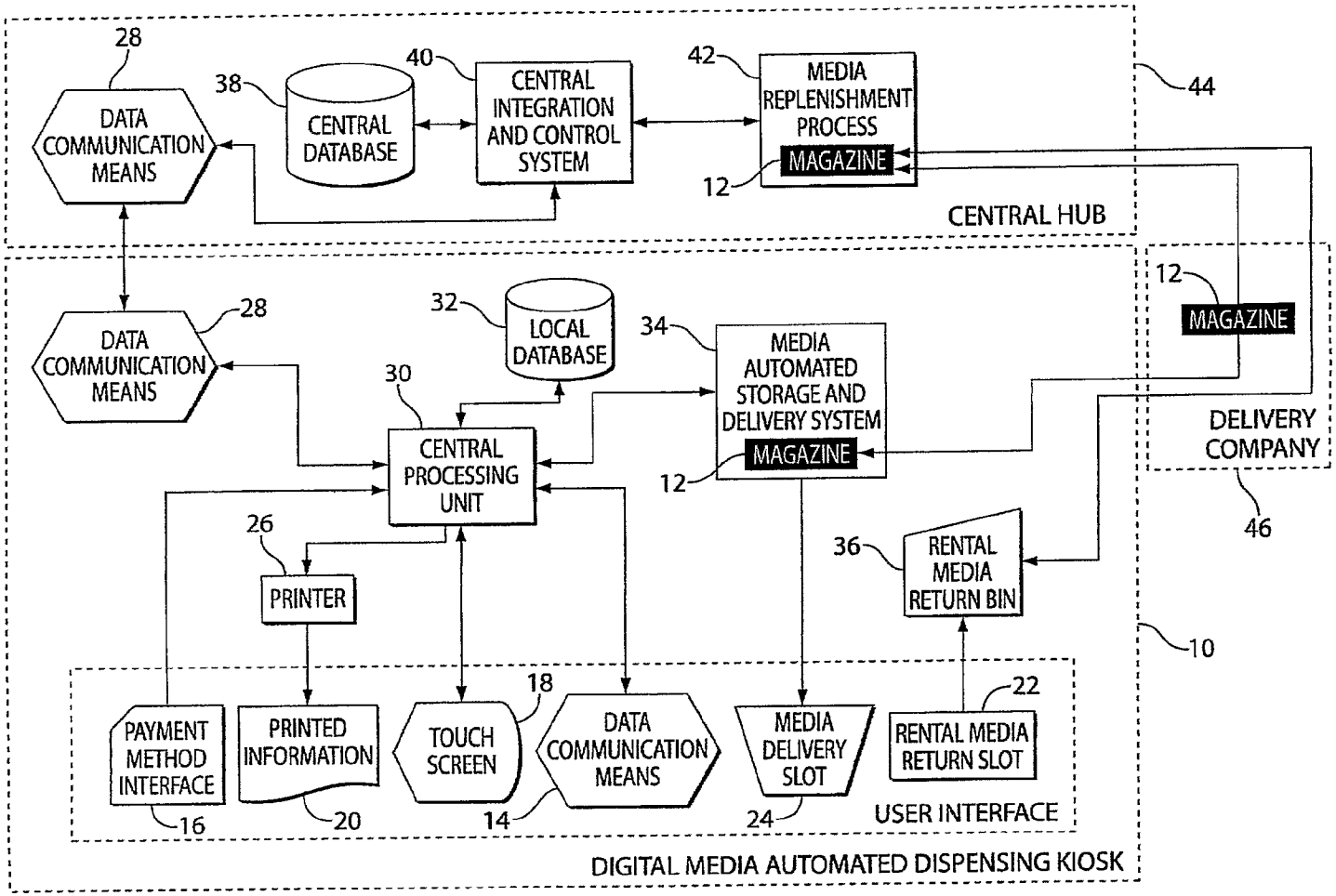
FIG. 8 is a flow diagram showing the functions of the kiosk (10) and the kiosk control hub (44). The diagram includes a slot (22) for returning titles into the rental media return bin (36). In embodiments where packages are returned via a delivery service, the role of the slot (22) and rental media return bin (36) would be performed by the delivery service.
Figure 9A:
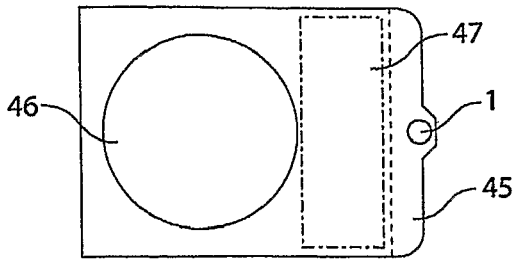
FIG. 9A shows the front face of an unclosed package including an opening (1), a lip (45) for closing, a transparent window (46), and an area (47) to contain printed text or graphics.
Figure 9B:
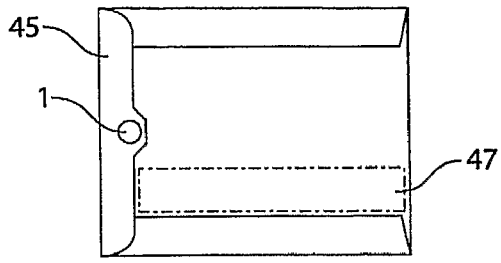
FIG. 9B shows a rear view of a closed package including an opening (1), a closed lip (45), and an area (47) to contain printed text or graphics.
Figure 9C:
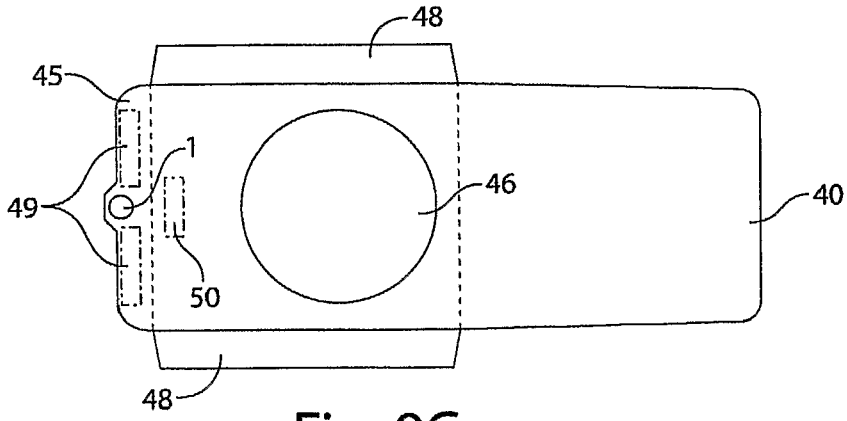
FIG. 9C shows an exploded view of the front face of an unclosed package including an opening (1), a lip (45) for closing, a transparent window (46), as well as edges (48) and an opposite face (40) for closing during use. The package also contains glued portions (49) on the lip (45) for closing the package and a second transparent window (50) for reading information from inside the package.
Figure 9D:
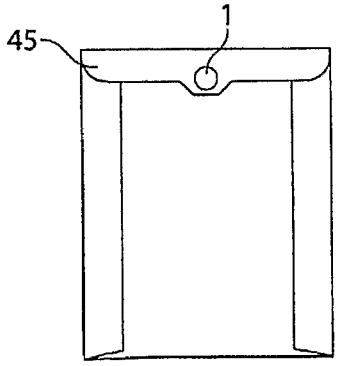
FIG. 9D shows a rear view of a closed package including an opening (1), a closed lip (45).
Figure 10A:
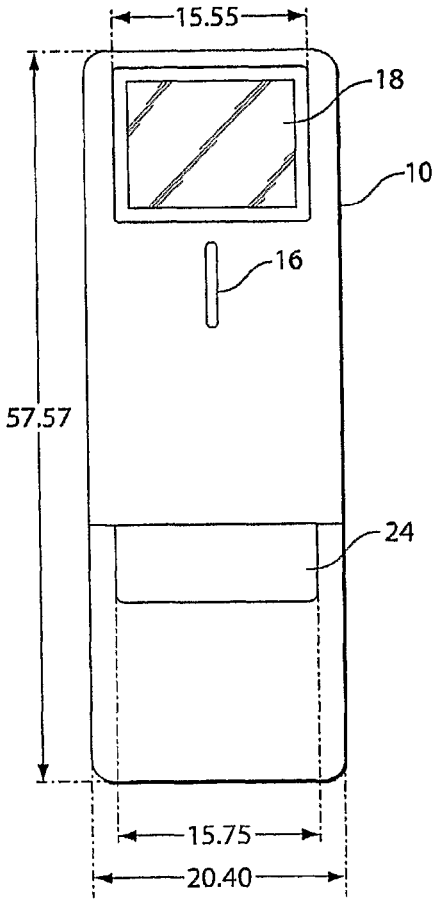
FIG. 10 shows a front (FIG. 10A) and side (FIG. 10B) view of a kiosk (10) with a magnetic band reader (16) for electronic payment, a touch screen (18) for interacting with the kiosk, and a slot (24) where the kiosk delivers the product.
Figure 10B:
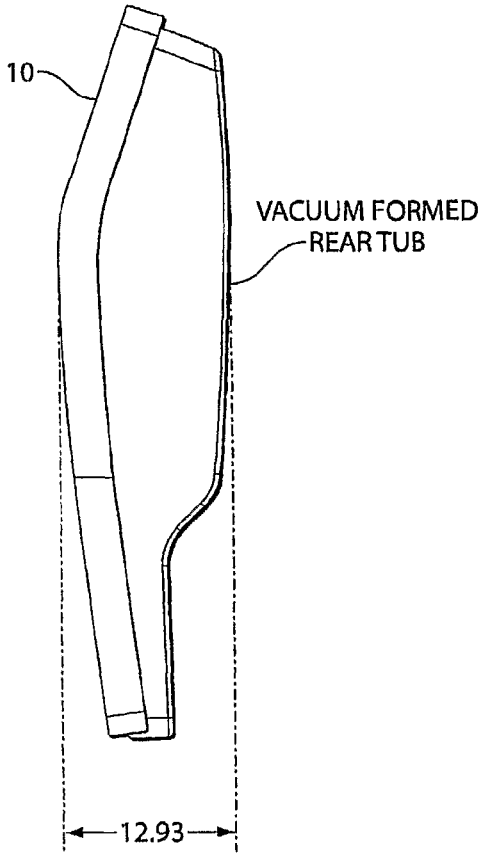
Figure 11:
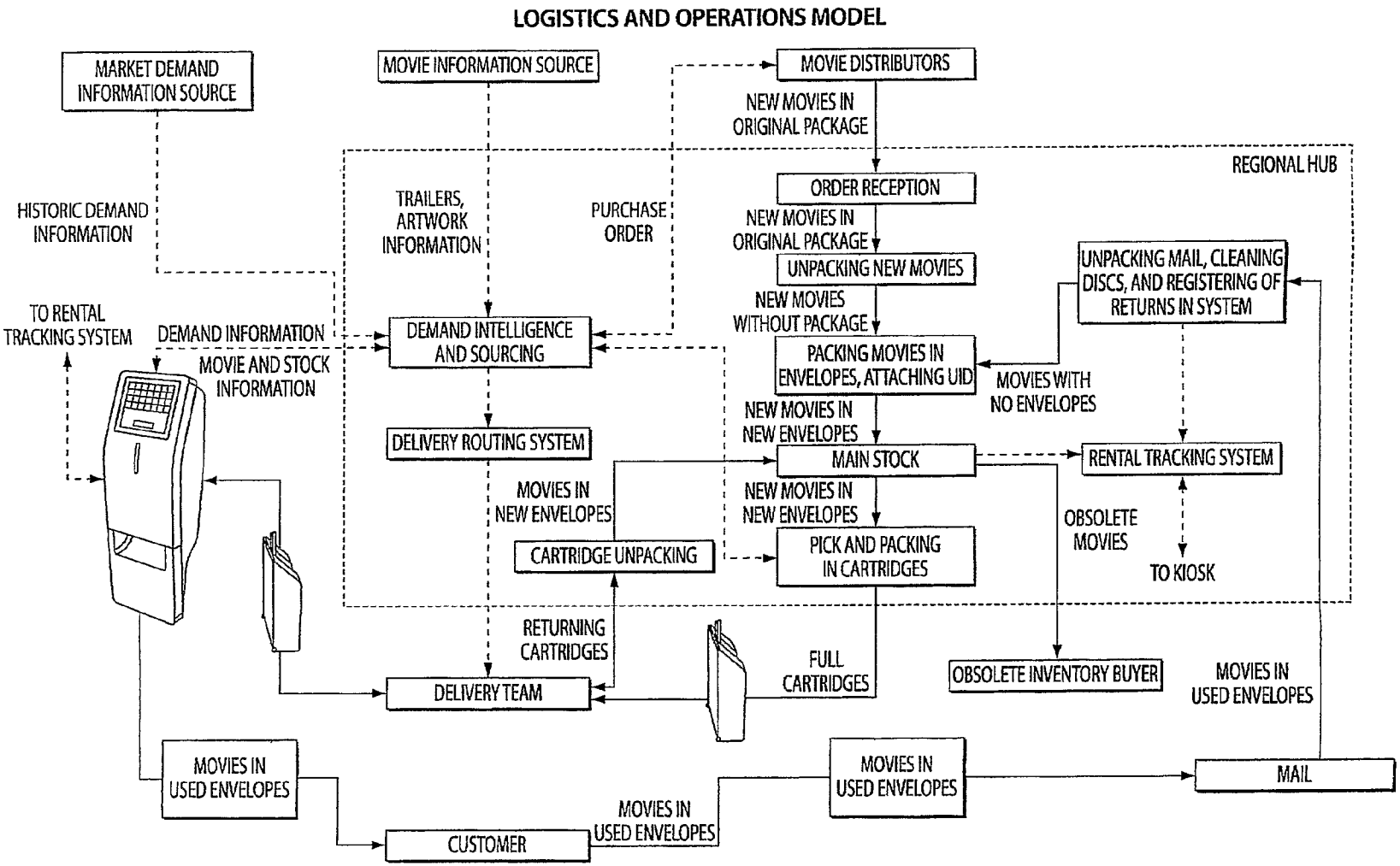
FIG. 11 is a flow diagram showing the method of operating a kiosk according to an embodiment of the invention.

As represented in FIG. 8, a user approaches a kiosk (10) and interacts with touch screen (18) to enter and obtain information to select a title. The touch screen provides the users input to the central processing unit (the kiosk computer brain) (30), which interacts with the local database (32). The local database stores digital information about the 40 titles contained in the kiosk and previous transactions, as well as the software required for the interface and the general operation of the kiosk.

The user purchases the title via the electronic payment method, specifically a magnetic band reader (16). When the purchase is complete, the central processing unit directs the magazine (12), which is contained in the receptacle (34), to release a movie into the media delivery slot (24), and the central processing also directs the printer (26) to issue a receipt to the customer via slot (20).

Figure 2:
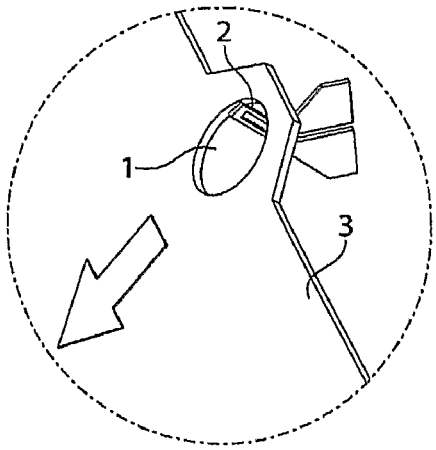
FIG. 2 shows a close up of the package (3), the opening (1), and the tab (2), before dispensing.
Figure 3:
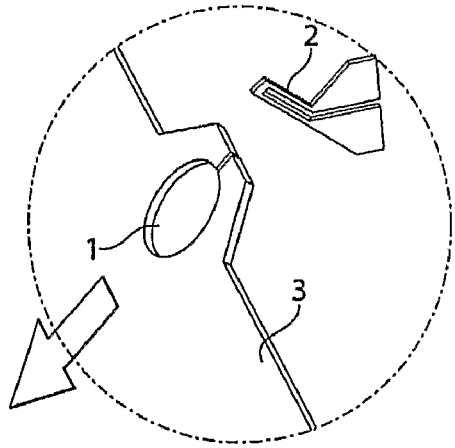
FIG. 3 shows a close up of the package (3), the opening (1), and the tab (2) during dispensing. The current applied to the tab (2) heated the tab and melted the part of the package it was in contact with, resulting in the package being cut and the opening (1) expanding to include a slit. The package (1) then falls due to gravity as shown by the arrow.
Figure 4:
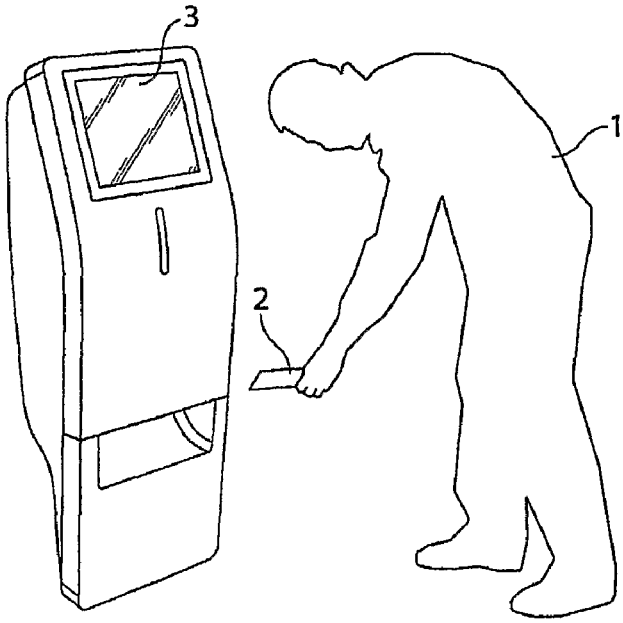
FIG. 4 shows a customer (1) retrieving from the kiosk (3) a package (2) containing a product.

As shown in FIGS. 1 and 2, each title is contained within a package. Each package (3) holding the product contains an opening (2). The opening (1) hangs from a metal tab (2). The central processing unit directs the magazine to dispatch the purchased title by sending an electric current to the tab corresponding to that title. As shown in FIG. 3, when an electric current is applied to the tab (2), it heats that tab, melting the part of the package it was in contact with, forming a slit through the package between the opening and the top of the package. The package (1) then falls from gravity as shown by the arrow.

Figure 5:
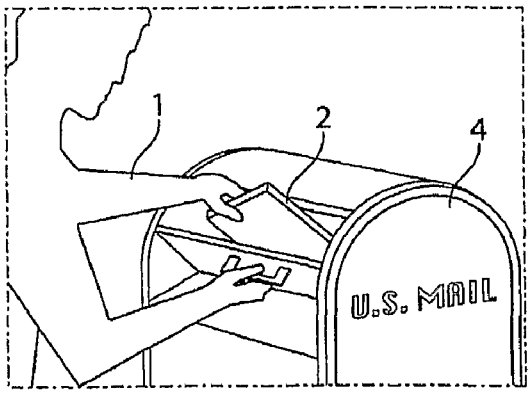
FIG. 5 shows a customer (1) returning the package (2) containing a product via a mailbox (4).
Figure 6:
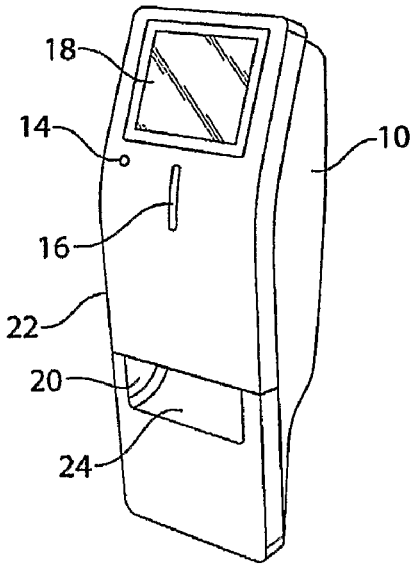
FIG. 6 shows a kiosk (10) with a wireless means (14) of transmitting digital information to a portable electronic device, a magnetic band reader (16) for electronic payment, a touch screen (18) for interacting with the kiosk, a slot (20) that delivers printed information, a slot (24) where the kiosk delivers the product, and a slot (22) for returning titles

FIG. 5 shows a customer (1) retrieving the purchased title, contained in a package (2), from the kiosk. In FIG. 6, the customer (1) returns the title to the vendor by placing the postage paid package (2) into the mail (4).

The kiosk (10) and the hub (44) communicate via data communication means shown in FIG. 8. The central integration and control system (40) of the hub controls the network by interacting with the central database (38). The central database can serve more than one kiosk and contains information on the whole network, including statistics of previous transaction characteristics of the titles in the system, status of the delivery of the magazines, replenishment requirements of each kiosk, and the software required for operation.

The central integration and control system (40) also controls the media replenishment process (42), which is the automated or manual system that receives the magazines from the kiosks. These magazines may be empty or may contain the titles that where not rented or sold. In an embodiment, it may also receive the titles returned in the return bins and through mail. The system checks the integrity of the returning titles, replaces the damaged ones and replenishes each magazine with a special selection that reflects the demand of the kiosks to which the magazine will be delivered.

When new inventory is required, the media replenishment process directs a delivery company (46) to deliver a new magazine and pick up an old magazine from a kiosk. The delivery company's personnel can exchange the magazines.

Figure 7:
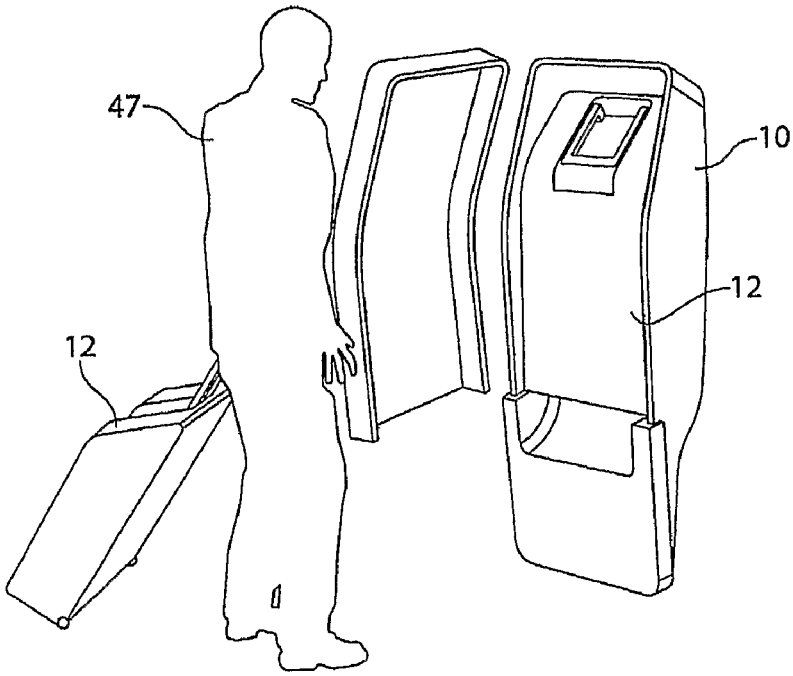
FIG. 7 shows the kiosk having its inventory changed. The kiosk (10) is opened, revealing the cartridge (12) with old inventory. The delivery personnel (4) removes the old cartridge (12), replaces it with a new cartridge (12), and closes the kiosk (10).

FIG. 6 shows a closed kiosk before changing a magazine, and FIG. 7 shows an open kiosk during magazine changing. When a delivery personnel (47) brings a replacement magazine (12) close to the kiosk, the kiosk senses the new magazine's Radio Frequency Identity (RFID) tag and opens, exposing the old magazine, as shown in FIG. 7. The old magazine can be easily removed and the new one introduced in a simple two-step process by package delivery personnel.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only. The appended claims constitute part of the disclosure of the invention.

The invention claimed is:

1. A device for storing and delivering an article on demand comprising:

a kiosk;

a storage container that comprises an enclosed container configured to contain a plurality of the articles and configured to be readily removable from the kiosk;

a user interface configured to enable a user to indicate a selection of at least one of the articles to be delivered by the device to a location accessible to the user; and a retainer within the storage container configured to secure the plurality of articles within the storage container and to release only the article selected by the user;

wherein the retainer is constructed so that it releases the selection without mechanical motion of any part of the retainer configured to secure the plurality of articles; and wherein each article is retained in a package and the retainer comprises, for each package, a projection comprising an electrically conductive material from which the package hangs, wherein, when an electrical current is applied to the electrically conductive material, the projection heats and melts through a portion of the package contacting the projection, thereby releasing the package.

2. A device as in claim 1, wherein the location accessible to the user comprises an opening in the kiosk comprising a slot, basket, or tray.

3. The device as in claim 1, wherein the package is made of styrofoam, polypropylene, or polyethylene.

4. The device as in claim 1, wherein the package is made of polyethylene.

5. A device as in claim 1, wherein the user interface comprises a computer-implemented system in electrical communication with the retainer.

6. A device as in claim 1, wherein each projection comprises a planar surface and a narrow edge and is configured to be positioned within an opening of a package such that the package is secured in the storage container by contacting the narrow edge of the projection at the perimeter of the opening.

7. A device as in claim 6, wherein each projection is composed of an electrically conductive material and is configured such that when the user selects the article contained within the package an electrical potential is applied to the projection, and when the electrical potential is applied to the projection the electrical current passes through the projection such that the projection heats and melts through the portion of the package that is in contact with the projection, forming a slit through the package between the opening and the top of the package, thereby releasing the package.

8. A device as in claim 1, wherein each projection is composed of an electrically conductive material and is configured such that when the user selects the article contained within the package an electrical potential is applied to the projection, and when the electrical potential is applied to the projection the electrical current passes through the projection such that the projection heats and melts through the portion of the package that is in contact with the projection, forming a slit through the package between the opening and the top of the package, thereby releasing the package.

9. A device as in claim 1, wherein the storage container is configured to secure the plurality of articles such that the articles are staggered at an angle in the storage container.

10. A device as in claim 1, wherein the article comprises a digital video disc (DVD), compact disc (CD), UMD optical disc, HD-D, memory card, video tape cassette, audio tape cassette, or other article comprising a computer readable medium.

11. A device as in claim 1, wherein the article comprises a written publication, an audio publication, digital media, a movie, a documentary, a game, software, tourist information, a plane ticket, a travel ticket, an event ticket, money, snacks or food.

12. A device as in claim 1, wherein the enclosed storage container comprises a mechanism that signals its proximity to the device.

13. A device as in claim 12, wherein the mechanism that signals proximity to the device is an RFID chip.

14. A device as in claim 13, wherein, when the enclosed storage container is outside the device, the mechanism that signals its proximity to the device causes the device to open.

15. A device as in claim 1 further comprising a return bin configured for receiving articles through a return slot in the user interface.

16. A device for storing and delivering an article on demand comprising:

a kiosk;

a storage container configured to contain a plurality of the articles, and configured to be readily insertable into the kiosk;

a user interface configured to enable a user to indicate a selection of at least one of the articles to be delivered by the device to a location accessible to the user; and a retainer within the storage container configured to secure the plurality of articles within the storage container and to release only the article selected by the user;

wherein the retainer is constructed so that it releases the selection without mechanical motion of any part of the retainer configured to secure the plurality of articles; and wherein each article is retained in a package and the retainer comprises, for each package, a projection comprising an electrically conductive material from which the package hangs, wherein, when an electrical current is applied to the electrically conductive material, the projection heats and melts through a portion of the package contacting the projection, thereby releasing the package.

17. A device as in claim 16, wherein each projection comprises a planar surface and a narrow edge and is configured to be positioned within an opening of a package such that the package is secured in the storage container by contacting the narrow edge of the projection at the perimeter of the opening.

18. A device as in claim 17, wherein each projection is composed of an electrically conductive material and is configured such that when the user selects the article contained within the package an electrical potential is applied to the projection, and when the electrical potential is applied to the projection the electrical current passes through the projection such that the projection heats and melts through the portion of the package that is in contact with the projection, forming a slit through the package between the opening and the top of the package, thereby releasing the package.

19. A device as in claim 16, wherein the storage container is configured to secure the plurality of articles such that the articles are staggered at an angle in the storage container.

20. A device for storing and delivering an article on demand comprising:

a storage container configured to contain a plurality of the articles;

a user interface configured to enable a user to indicate a selection of at least one of the articles to be delivered by the device to a location accessible to the user; and a retainer within the storage container configured to secure the plurality of articles within the storage container and to release only the article selected by the user, wherein the retainer comprises at least one securing component, at least a portion of which comprises an electromagnet, wherein the retainer is constructed so that it releases the selection without mechanical motion of any part of the retainer configured to secure the plurality of articles; and wherein each article is retained in a package and the retainer comprises, for each package, a projection comprising an electrically conductive material from which the package hangs, wherein, when an electrical current is applied to the electrically conductive material, the projection heats and melts through a portion of the package contacting the projection, thereby releasing the package.

21. A device for storing and delivering an article on demand comprising:

a kiosk;

a storage container that comprises an enclosed container configured to contain a plurality of the articles and configured to be readily removable from or insertable into the kiosk;

a user interface configured to enable a user to indicate a selection of at least one of the articles to be delivered by the device to a location accessible to the user; and a retainer within the storage container configured to secure the plurality of articles within the storage container and to release only the article selected by the user;

wherein the retainer is constructed so that it releases the selection without mechanical motion of any part of the retainer configured to secure the plurality of articles; and wherein the retainer comprises, for each article, a projection comprising an electrically conductive material from which the article hangs, wherein, when an electrical current is applied to the electrically conductive material, the projection heats and melts through a portion of the article contacting the projection, thereby releasing the article.

* * * * *